US012781129B2

(12) United States Patent
Park et al.

(10) Patent No.: US 12,781,129 B2
(45) Date of Patent: Nov. 3, 2026

(54) PYROLYSIS CONTROL APPARATUS AND METHOD USING IMAGE INFORMATION OF RAW MATERIALS AND PRODUCTS

(71) Applicant: INSTITUTE FOR ADVANCED ENGINEERING, Yongin-si (KR)

(72) Inventors: Yeong Su Park, Yongin-si (KR); Ho Jin Sung, Yongin-si (KR); Chae Young Lim, Yongin-si (KR)

(73) Assignee: INSTITUTE FOR ADVANCED ENGINEERING, Yongin-si (KR)

( * ) Notice: Subject to any disclaimer, the term of this patent is extended or adjusted under 35 U.S.C. 154(b) by 139 days.

(21) Appl. No.: 18/807,495

(22) Filed: Aug. 16, 2024

(65) Prior Publication Data

US 2025/0188352 A1 Jun. 12, 2025

(30) Foreign Application Priority Data

Dec. 6, 2023 (KR) ..... 10-2023-0176028
Mar. 26, 2024 (KR) ..... 10-2024-0041179

(51) Int. Cl.
*C10B 41/00* (2006.01)
*C10B 23/00* (2006.01)
(Continued)

(52) U.S. Cl.
CPC ..... *C10B 23/00* (2013.01); *C10B 41/00* (2013.01); *C10B 41/02* (2013.01); *C10B 47/30* (2013.01); *C10B 47/44* (2013.01)

(58) Field of Classification Search
None
See application file for complete search history.

(56) References Cited

U.S. PATENT DOCUMENTS 9,005,400 B2 * 4/2015 Wechsler ..... C10B 47/44 585/242
10,706,334 B2 * 7/2020 Pan ..... G06F 18/253
(Continued)

FOREIGN PATENT DOCUMENTS

CN 109724398 A 5/2019
JP 2002-88377 A 3/2002
(Continued)

OTHER PUBLICATIONS

"What Is a Database?", Nov. 24, 2020, Oracle, https://www.oracle.com/database/what-is-database/, Retrevied Feb. 20, 2026.*
(Continued)

*Primary Examiner* — Jonathan Luke Pilcher
(74) *Attorney, Agent, or Firm* — Birch, Stewart, Kolasch & Birch, LLP

(57) ABSTRACT

Disclosed is a pyrolysis reaction method including a raw material input step of inputting a raw material and acquiring first data, a pyrolysis reaction step of pyrolyzing the input raw material, a reactant discharge step of discharging a pyrolyzed reactant and acquiring second data, an image sample collection step of additionally obtaining image samples, a DB storage step of normalizing the obtained image samples into time series data and storing RGB code values in a DB, a labeling step of assigning labels to the first data and the second data, a data processing step of comparing the first data and the second data with the data stored in the DB to generate third data and fourth data, and a control value deriving step of deriving control values of a pyrolysis temperature and a pyrolysis time based on the third data and the fourth data.

12 Claims, 9 Drawing Sheets

(51) Int. Cl.

| | |
|---|---|
| ***C10B 41/02*** | (2006.01) |
| ***C10B 47/30*** | (2006.01) |
| ***C10B 47/44*** | (2006.01) |

(56) References Cited

U.S. PATENT DOCUMENTS

| | | | |
|---|---|---|---|
| 11,465,948 | B2 | 10/2022 | Aramburu et al. |
| 2018/0208851 | A1 | 7/2018 | Endou et al. |
| 2022/0051393 | A1 | 2/2022 | Chaudhuri et al. |
| 2022/0315854 | A1 | 10/2022 | Despres et al. |

FOREIGN PATENT DOCUMENTS

| | | | | |
|---|---|---|---|---|
| JP | 2008-180451 | A | | 8/2008 |
| JP | 2016121924 | A | * | 7/2016 |
| JP | 6090994 | B2 | | 3/2017 |
| JP | 2021-38914 | A | | 3/2021 |
| JP | 2022-538235 | A | | 9/2022 |
| JP | 2023-28013 | A | | 3/2023 |
| KR | 10-2004-0018582 | A | | 3/2004 |
| KR | 10-2014-0031658 | A | | 3/2014 |
| KR | 10-2016-0143266 | A | | 12/2016 |
| KR | 10-1728665 | B1 | | 4/2017 |
| KR | 10-2017-0079170 | A | | 7/2017 |
| KR | 10-1807077 | B1 | | 12/2017 |
| KR | 10-1852348 | B1 | | 6/2018 |
| KR | 10-2023-0050352 | A | | 4/2023 |
| KR | 10-2024-0041179 | A | | 3/2024 |
| WO | WO 2017/017838-1 | | | 2/2017 |
| WO | WO 2023/041841 | A1 | | 3/2023 |

OTHER PUBLICATIONS

Rahman, Abdur & Marufuzzaman, Mohammad & Street, Jason & Wooten, James & Gude, Veera Gnaneswar & Wang, Haifeng. (2023). An Interpretable Deep Learning Model for Wood Chip Moisture Content Prediction. 10.21872/2023IISE_1810.*

PE2E translation of JP-2016121924-A.*

* cited by examiner

【FIG. 1】
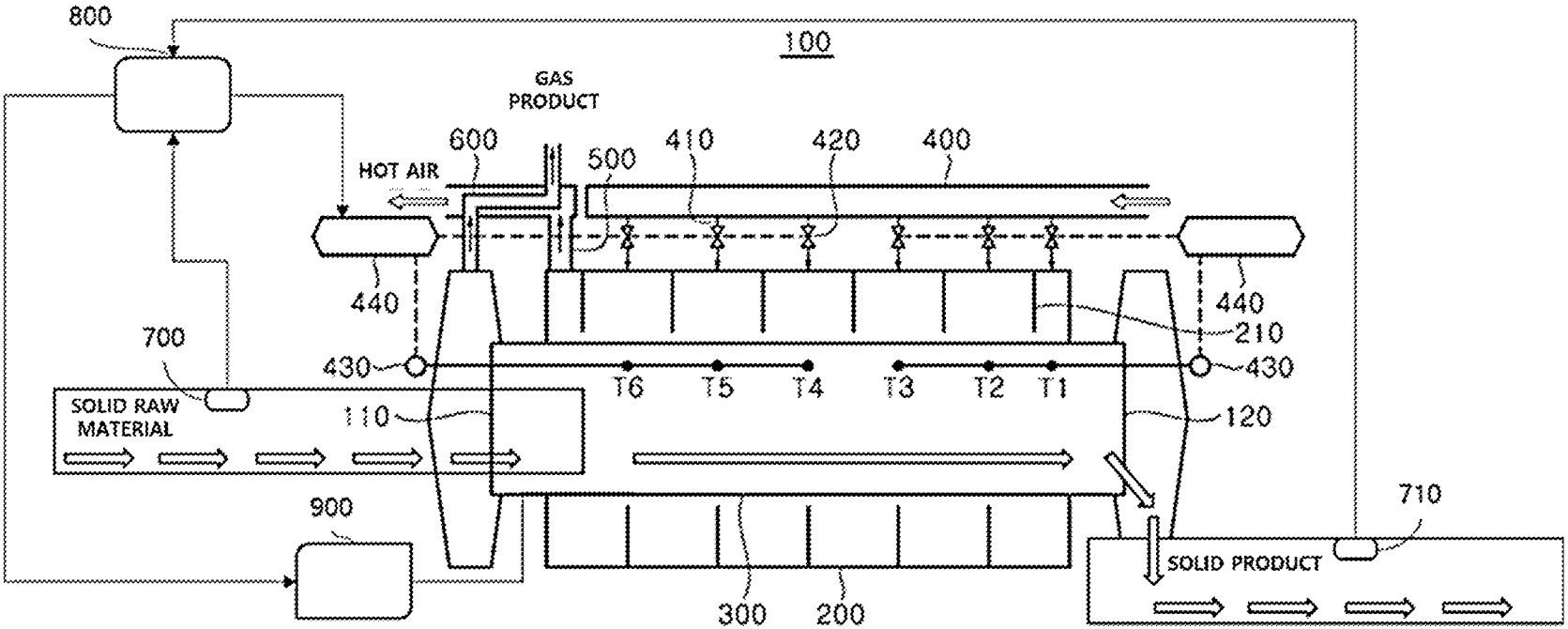

【FIG. 2】
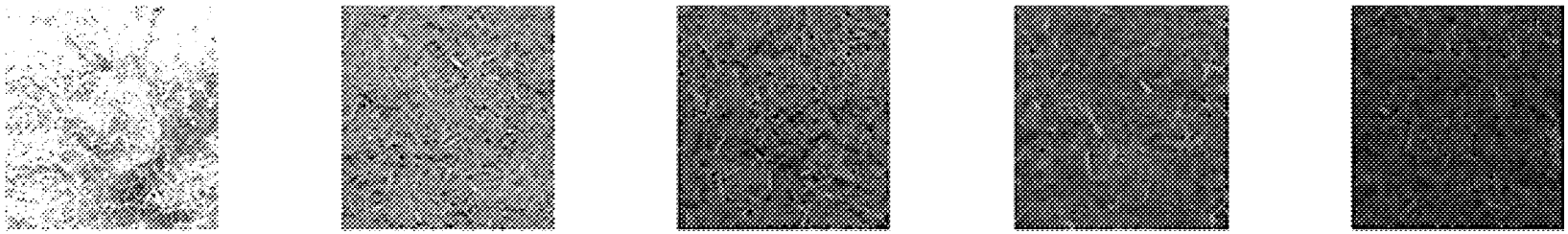

【FIG. 3】

| REACTION TEMPERATURE | RAW MATERIAL | 205°C | 245°C | 275°C | 290°C |
|---|---|---|---|---|---|
| PRODUCT IMAGE | | | | | |
| HEATING VALUE | 4,633 kcal/kg | 4,640kcal/kg | 4,938kcal/kg | 5,818kcal/kg | 6,077kcal/kg |
| YIELD | | 93.1 | 76.7 | 55.6 | 47.4 |
| C CONTENT | 47.5 | 48.2 | 50.2 | 58.5 | 61.1 |
| H CONTENT | 6.0 | 5.9 | 5.8 | 5.5 | 5.0 |
| O CONTENT | 45.5 | 41.8 | 38.7 | 29.5 | 25.7 |
| O/C mole ratio | 0.7 | 0.7 | 0.6 | 0.4 | 0.3 |
| H/C mole ratio | 1.5 | 1.5 | 1.4 | 1.1 | 1.0 |
| R | 81 | 68 | 34 | 29 | 38 |
| G | 69 | 59 | 35 | 30 | 40 |
| B | 39 | 39 | 29 | 28 | 35 |

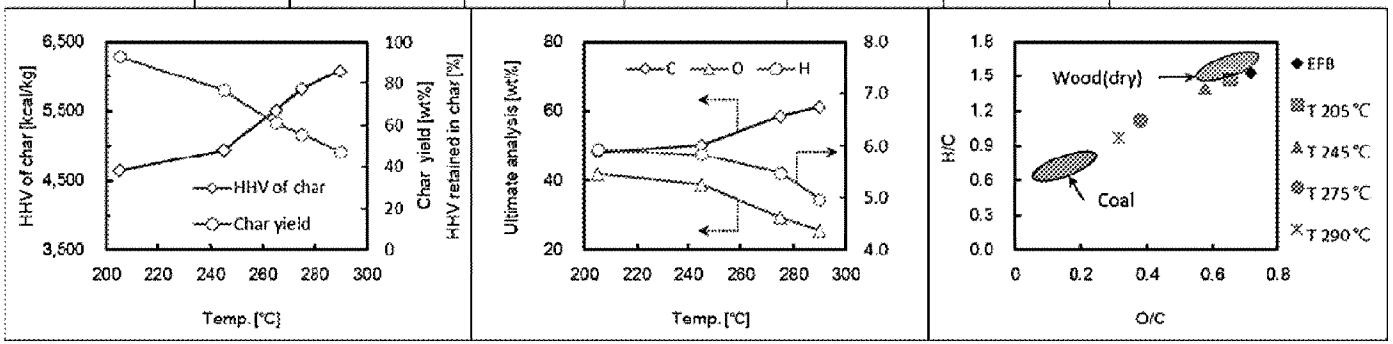

<HIGHER HEATING VALUE AND YIELD OF TORREFIED PRODUCT DEPENDING ON REACTION TEMPERATURE>

<ELEMENTAL COMPOSITION OF TORREFIED PRODUCT DEPENDING ON REACTION TEMPERATURE>

<RELATIONSHIP BETWEEN O/C AND H/C OF TORREFIED PRODUCT DEPENDING ON REACTION TEMPERATURE>

【FIG. 4】
| REACTION TEMPERATURE | RAW MATERIAL | 310℃ | 265℃ | 245℃ |
|---|---|---|---|---|
| REACTION TIME | RAW MATERIAL | 10min | 30min | 40min |
| PRODUCT IMAGE | 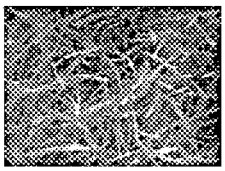 | 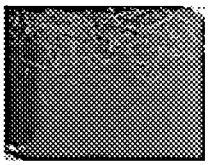 | 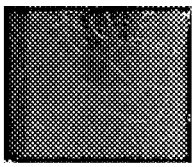 | 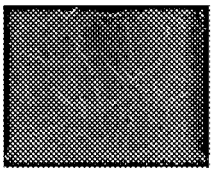 |
| HEATING VALUE | 4,633 kcal/kg | 4,928kcal/kg | 4,938kcal/kg | 4,846kcal/kg |
| YIELD | | 80.4 | 76.7 | 80.0 |
| R | 81 | 35 | 29 | 33 |
| G | 69 | 36 | 30 | 34 |
| B | 39 | 32 | 26 | 27 |
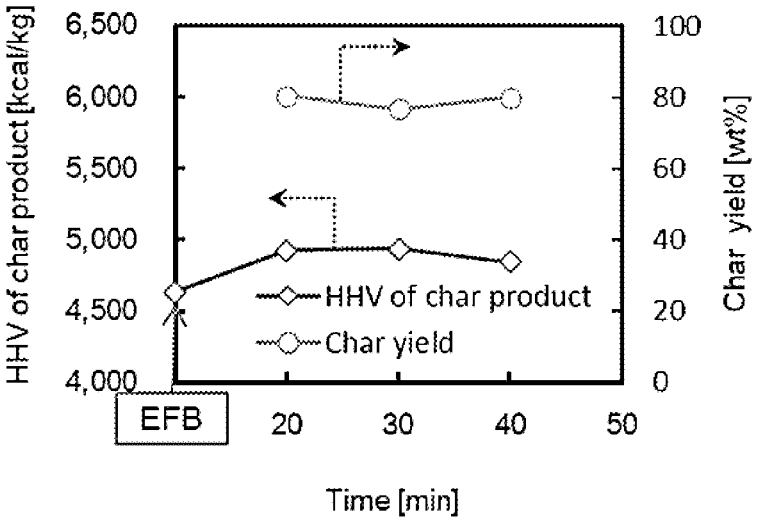
HIGHER HEATING VALUE AND YIELD OF TORREFIED PRODUCT DEPENDING ON REACTION TIME 【FIG. 5】
| REACTION TEMPERATURE | RAW MATERIAL | 310°C | 265°C | 245°C |
|---|---|---|---|---|
| REACTION TIME | | 10min | 30min | 40min |
| PRODUCT IMAGE | 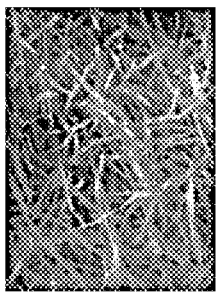 | 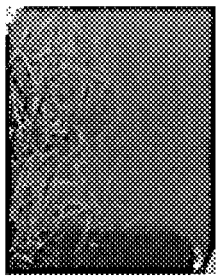 | 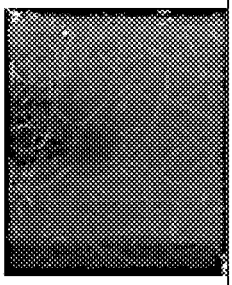 | 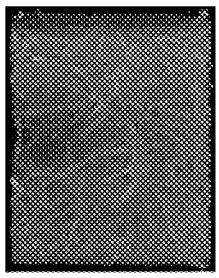 |
| HEATING VALUE | 4,633 kcal/kg | 4,928kcal/kg | 4,938kcal/kg | 4,846kcal/kg |
| R | 81 | 37 | 32 | 31 |
| G | 69 | 39 | 33 | 32 |
| B | 39 | 35 | 30 | 27 |
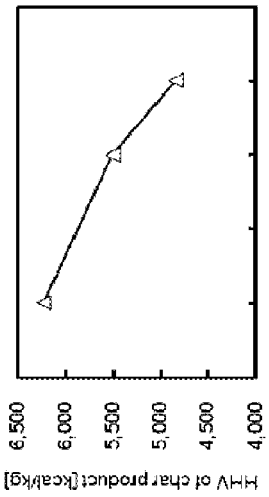
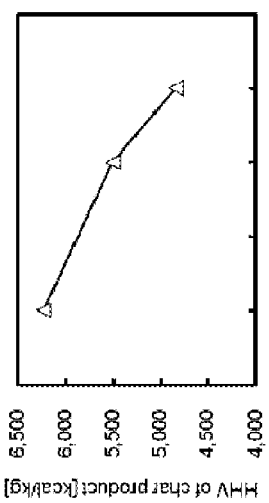

【FIG. 6】
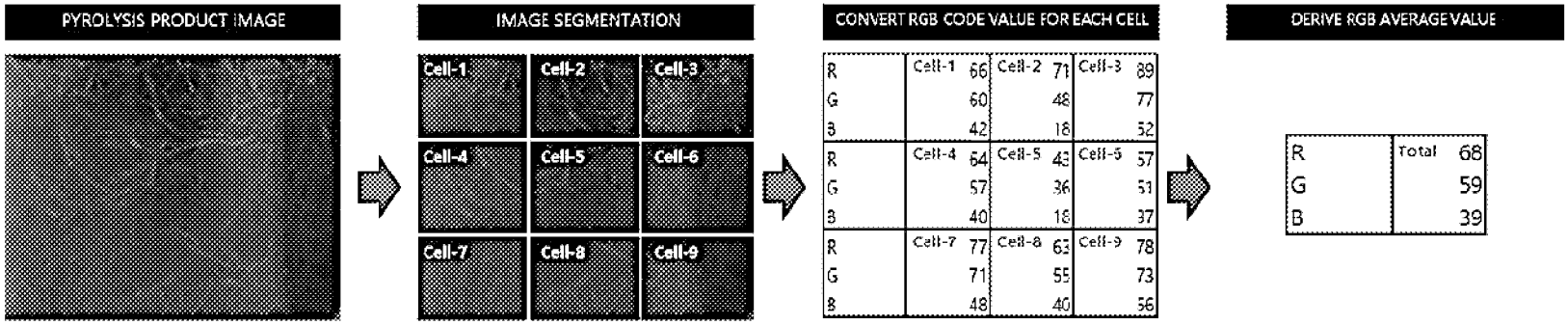

【FIG. 7】
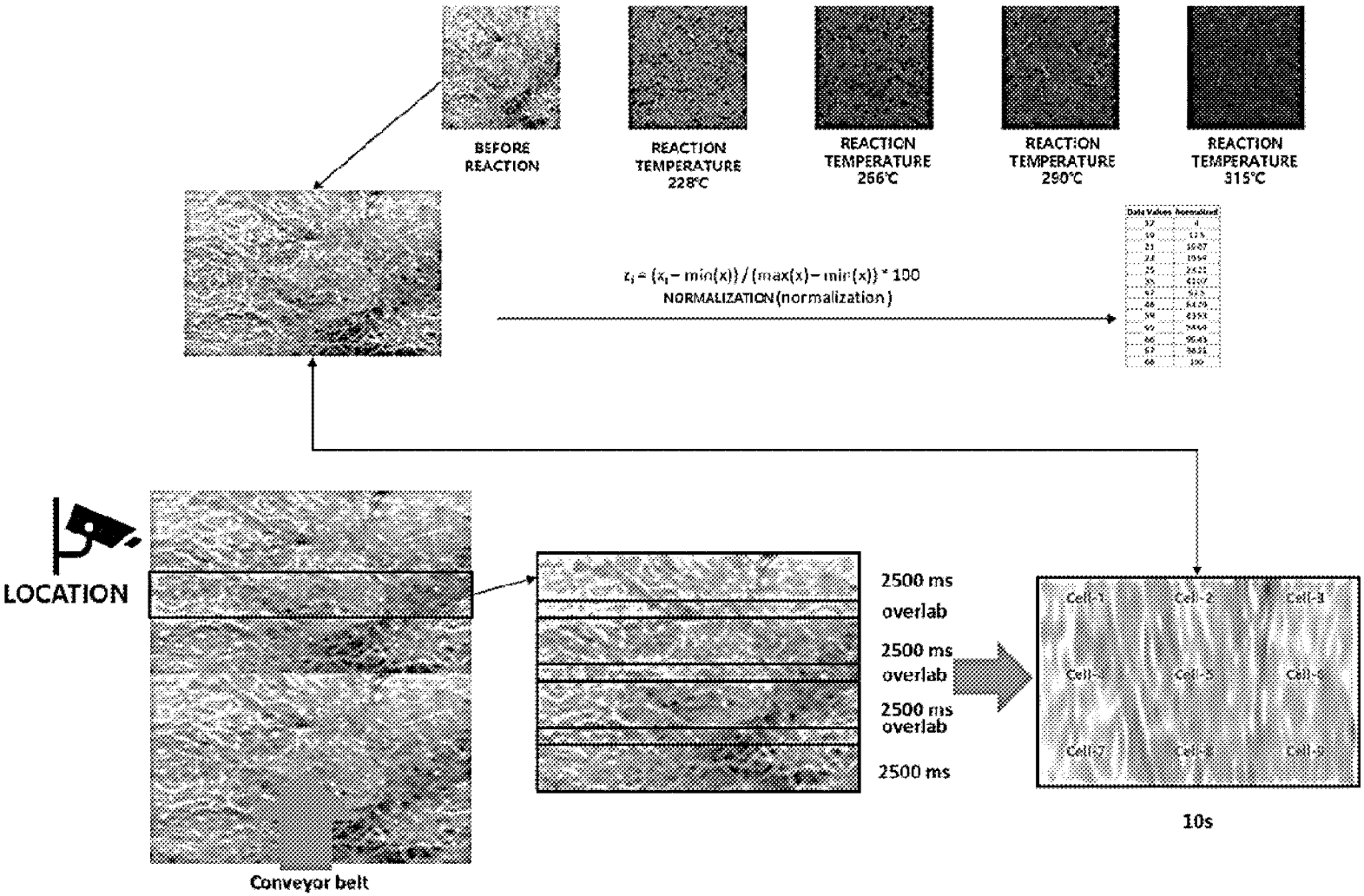

【FIG. 8】
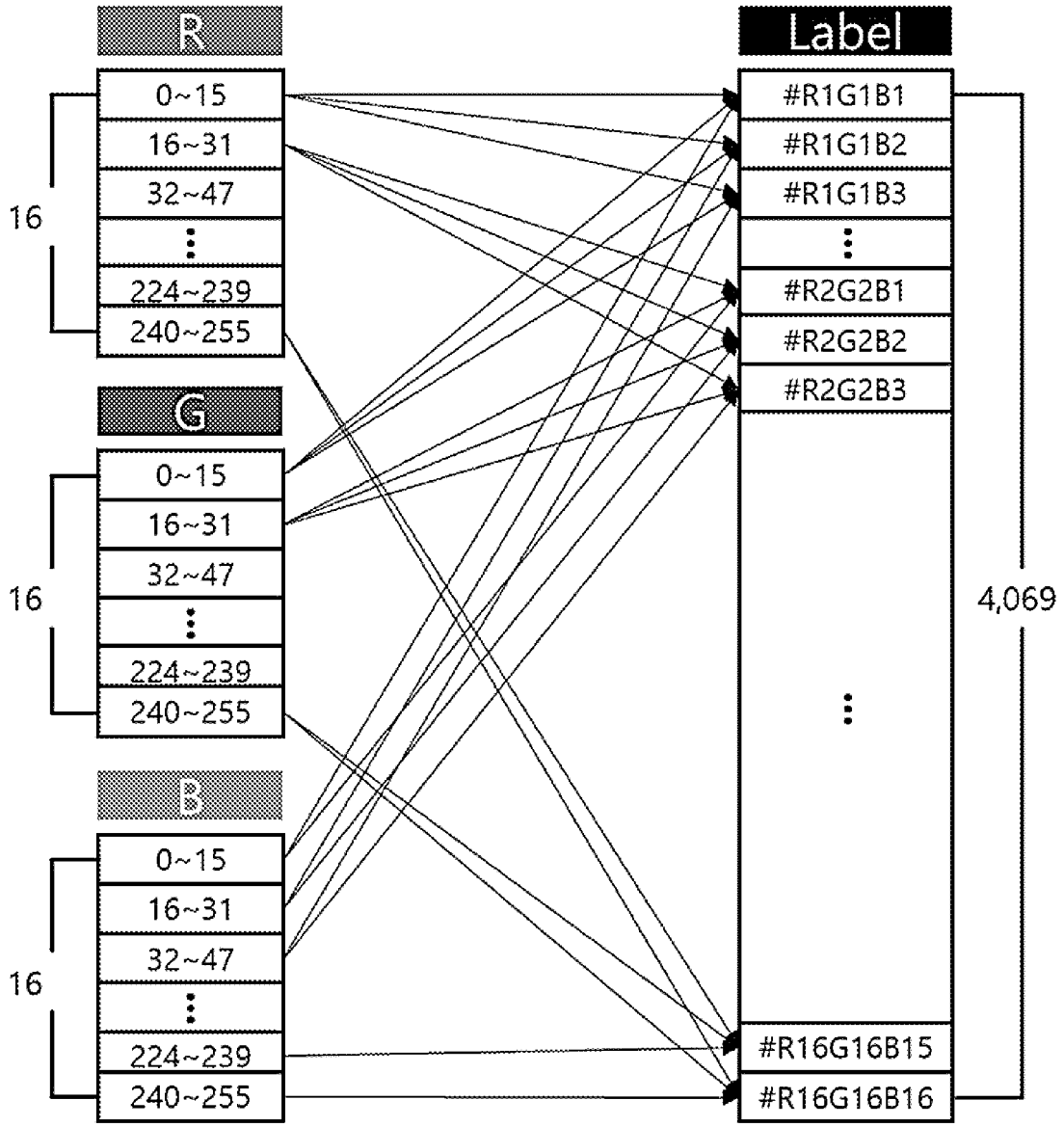

【FIG. 9】
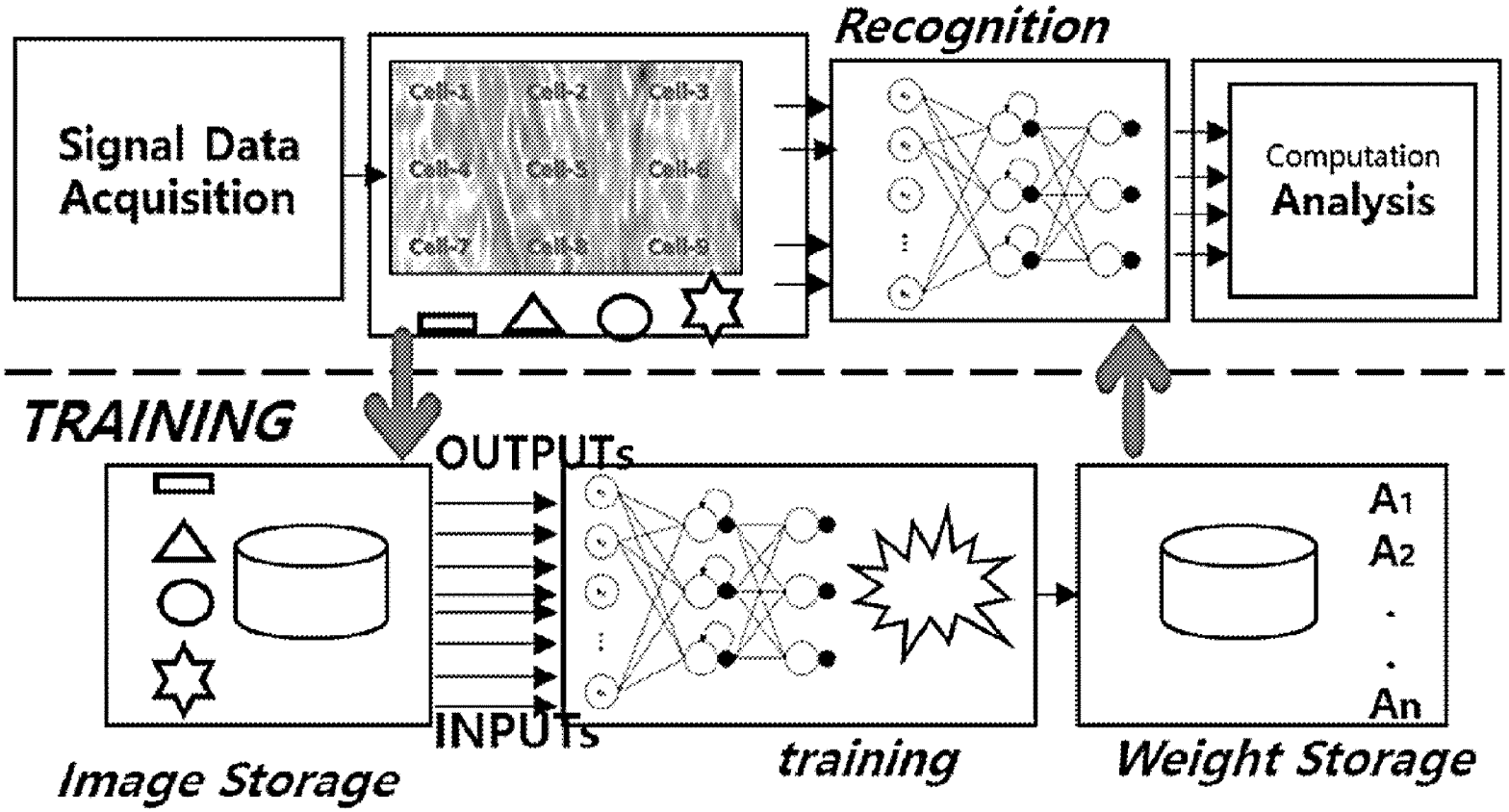

PYROLYSIS CONTROL APPARATUS AND METHOD USING IMAGE INFORMATION OF RAW MATERIALS AND PRODUCTS

TECHNICAL FIELD

The present invention relates to a control apparatus and method using pyrolysis raw material and product image information, and more particularly to a control apparatus and method using pyrolysis raw material and product image information capable of monitoring images of an input solid raw material and a pyrolyzed solid product and enabling efficient progress of pyrolysis reaction through real-time AI analysis and operating parameter control.

BACKGROUND ART

Biofuel produced from biomass is decomposed into water and carbon dioxide during combustion, and the carbon dioxide is reabsorbed back into biomass by photosynthesis as the organism grows and is add to the component content of the biomass, and therefore biofuel is defined as a carbon neutral fuel. However, the heating value of biomass is low due to the high water thereof, which reduces the operating efficiency content and energy production efficiency of self-combustion, and therefore it is necessary to improve the quality of biomass fuel through a torrefaction process at a temperature of 250 to 300° C. under anoxic conditions.

In addition, carbon in biochar, which is produced by pyrolysis of biomass at a temperature of 350° C. or higher under a limited oxygen condition, is rearranged into a stable structure and is not degraded by microorganisms even when injected into the soil, and carbon may be sequestered in the soil for a long period of time, attracting much attention as a climate change mitigation technology. Due to safety thereof in the soil, biochar is able to semi-permanently sequester a carbon source in the soil, reducing greenhouse gas emission and increasing crop yields through soil improvement.

The reactor the most commonly used in biomass pyrolysis processes is a rotary kiln reactor, wherein heat and mass transfer between biomass particles and a heat source medium is achieved by a kiln rotating about a rotating shaft. The rotary kiln reactor is a proven technology in a wide range of applications, and may directly or indirectly pyrolyze biomass using hot air generated through combustion. The flow of feedstock and the heat source medium may be configured in a co-current or counter-current manner, usually in a co-current manner to facilitate drying. The residence time of the biomass in the reactor may be controlled by the rotation speed and tilt of the kiln, since the biomass particles move while being rotated by the rotation of the kiln.

Image recognition and interpretation technology is capable of recognizing and classifying surrounding objects due to a recent development in AI technology, wherein it is possible to find identifiable features such as color and shape by learning various types of images, and it is possible to accurately recognize and label each feature by cross-referencing the same with thousands of other images. In recent years, therefore, the integration of AI object recognition technology into the quality control process of products has led to a growing number of meaningful use cases.

Conventional rotary kiln technology relies only on the reaction temperature measured by thermocouples to control the operation conditions, such as the amount of hot air and the rate of rotation, and it is difficult to preemptively respond to changes in the input conditions of target raw materials, which makes it difficult to secure the quality and output of a final product, and ultimately the economics of product production become a problem. Therefore, it is necessary to utilize real-time estimation of quality from image recognition and analysis of raw materials and products as operating parameters for controlling the amount of hot air and the rate of rotation of the kiln. Korean Patent Application Publication No. 10-1807077 relates to an indirect type rotary kiln reactor, which includes a material to be dried inlet configured to allow a material to be dried to be input therethrough, a material to be dried outlet configured to allow the material to be dried to be discharged therethrough, an inner cylinder, which is a path configured to allow the input material to be dried to move therein, an outer cylinder disposed so as to surround the inner cylinder, the outer cylinder being a path configured to allow external hot air to move therein, a hot air supply pipe configured to supply hot air to the outer cylinder, and a hot air discharge pipe configured to discharge the supplied hot air, wherein the hot air supply pipe supplies hot air to each of two or more zones of the outer cylinder, the hot air and the material to be dried are not in direct contact, the outer cylinder includes a partition plate configured to divide the outer cylinder into two or more zones so as to correspond to the hot air supplied from the hot air supply pipe, one end of the partition plate is connected to the outer cylinder while the other end of the partition plate is spaced apart from the inner cylinder by a predetermined distance such that the hot air supplied through the hot air supply pipe is movable to the neighboring zones through the gap from the inner cylinder, the partition plate in an upper space of the outer cylinder is staggered with the partition plate in a lower space of the outer cylinder, hot air branch pipes diverge from the hot air supply pipe to supply the hot air to the respective zones of the outer cylinder divided by the partition plate, each of the hot air branch pipes includes a control valve configured to adjust the amount of hot air flowing therein, a multipoint thermocouple is installed in the inner cylinder to detect the reaction temperature in the inner cylinder corresponding to each of the zones divided by the partition plate installed in the outer cylinder, a heat source supply quantity control unit configured to adjust the control valve based on the reaction temperature in the inner cylinder measured by the multipoint thermocouple is included, a generated gas discharge pipe connected to the inner cylinder to discharge a gas product generated in the process of drying the material to be dried by the hot air is included, the generated gas discharge pipe and the hot air discharge pipe are formed in a double structure such that the generated gas discharge pipe can extend through the interior of the hot air discharge pipe, and the hot air for drying the material to be dried is adjusted depending on the reaction temperature gradient of the inner cylinder and supplied to the outer cylinder on a per zone basis.

Japanese Patent Application Publication No. 2008-180451 relates to an external heating rotary kiln and an operation method thereof, wherein the external heating rotary kiln includes a kiln inner cylinder configured to rotate in an axial direction and an outer cylinder configured to distribute heating gas around the kiln inner cylinder, a material to be treated being thermally treated in the kiln inner cylinder while being transported in the axial direction, wherein the kiln inner cylinder is provided with a means rotatably supported at a movable end configured to be movable in the axial direction and a stationary end to measure the thermal growth of the kiln inner cylinder in the axial direction and a plurality 41 non-contact thermometers located at a main wall of the outer cylinder to measure the shell temperature at a plurality of positions of the kiln inner cylinder in the axial direction.

Japanese Registered Patent Publication No. 6090994 relates to a carbide manufacturing method and a carbide quality inspection method, the carbide manufacturing method being performed to manufacture carbide from biomass using a carbonizer, wherein a profile, in which the optical properties indicative of the color of the carbide and the pulverizability of the carbide are measured for each carbonization condition under which the carbide is manufactured, is used, a first carbonization condition is specified in the profile as a carbonization condition corresponding to a carbide having desired pulverizability, the optical properties of a carbide manufactured using the carbonizer are measured, a second carbonization condition is specified in the profile as a carbonization condition corresponding to the optical properties, and the carbonizer is controlled such that the second carbonization condition matches the first carbonization condition.

Korean Registered Patent Publication No. 10-1728665 relates to a method of estimating the heating value of torrefied biomass using a color difference measurement method, wherein the method includes a step of processing and drying woody biomass, a step of inputting the woody biomass to a torrefaction reactor, heating the reactor, inputting nitrogen gas to the reactor to create an oxygen-free atmosphere, and thermally treating the woody biomass to torrefy the woody biomass under a high-temperature inert condition, and a step of crushing the biomass to measure a color difference between the original woody biomass and the torrefied biomass, compressing the obtained wood powder to form a disk, and measuring the disk with a color difference meter.

The prior art documents detect the reaction temperature in the kiln and controls the reaction temperature through the control valve, etc., but do not disclose a method of tracking the color-based heating value of the product and controlling the apparatus in real time using an image viewer such as a camera at the outlet through which a manufactured product is discharged, causing a problem that the continuous operation of the apparatus stops for efficient energy management and product status checking.

PRIOR ART DOCUMENTS

Patent Documents (Patent Document 0001) Korean Registered Patent Publication No. 10-1807077

(Patent Document 0002) Japanese Patent Application Publication No. 2008-180451

(Patent Document 0003) Japanese Registered Patent Publication No. 6090994

(Patent Document 0004) Korean Registered Patent Publication No. 10-1728665

SUMMARY OF INVENTION

Technical Problem

In the prior art documents, it is not possible to control the operation through observation in the environment in the reactor where it is difficult to secure visibility, the operation conditions such as the amount of hot air and the rate of rotation are controlled depending only on the reaction temperature measured by the thermocouple, and it is difficult to secure the quality of a final product due to the difficulty of responding to changes in the input conditions of a target raw material.

In addition, it takes a certain amount of time to confirm through separate moisture content analysis for the input raw material and separate heating value analysis for a product, and a function as a parameter for real-time operation control is impossible, whereby utilization as an operation parameter for controlling the amount of hot air and the rate of rotation of the kiln through real-time estimation is necessary.

Solution to Problem

The present invention provides a pyrolysis reaction method including a raw material input step of inputting a raw material and acquiring first data through a first monitoring means, a pyrolysis reaction step of pyrolyzing and moving the input raw material, a reactant discharge step of discharging a pyrolyzed reactant and acquiring second data through a second monitoring means, an image sample collection step of additionally obtaining image samples in order to improve accuracy of the first data and the second data, a DB storage step of normalizing the obtained image samples into time series data and storing RGB code values in a DB, a labeling step of assigning labels to the first data and the second data based on the stored DB values, a data processing step of assigning a water content evaluation value to the label of the first data to derive a correlation between the RGB value and the water content, assigning a heating value evaluation value to the label of the second data to derive a correlation between the RGB value and the heating value, and comparing the first data and the second data with the data stored in the DB through simulation to generate third data, which is an estimated water content, and fourth data, which is an estimated heating value, and a control value deriving step of deriving control values of the pyrolysis temperature and the pyrolysis time required to secure heating value-based quality of the pyrolyzed reactant based on the third data and the fourth data generated through the data processing step, wherein the pyrolysis reaction step is performed by a pyrolysis reaction means configured to perform at least one of torrefaction, biochar reaction, drying, activated carbon reaction, and carbonization.

In the control value deriving step, the pyrolysis temperature may control at least one of the rate of rotation of a raw material supply motor of a hot air furnace, the rate of rotation of an air supply motor of the hot air furnace, and the rate of rotation of a dilution air supply motor of a gas mixer.

In the control value deriving step, the pyrolysis time may control at least one of the rate of rotation of a driving motor of a rotary kiln and the rate of rotation of the raw material supply motor.

The present invention also provides a pyrolysis reaction apparatus including a raw material input means configured to input a raw material and to acquire first data through a first monitoring means, a pyrolysis reaction means configured to pyrolyze and move the input raw material, a reactant discharge means configured to discharge a pyrolyzed reactant and to acquire second data through a second monitoring means, an image sample collection means configured to additionally obtain image samples in order to improve accuracy of the first data and the second data, a DB storage means configured to normalize the obtained image samples into time series data and storing RGB code values in a DB, a labeling means configured to assign labels to the first data and the second data based on the stored DB values, a data processing means configured to assign a water content evaluation value to the label of the first data to derive a correlation between the RGB value and the water content, to assign a heating value evaluation value to the label of the second data to derive a correlation between the RGB value and the heating value, and to compare the first data and the second data with the data stored in the DB through simulation to generate third data, which is an estimated water content, and fourth data, which is an estimated heating value, and a control value deriving means configured to derive control values of the pyrolysis temperature and the pyrolysis time required to secure heating value-based quality of the pyrolyzed reactant based on the third data and the fourth data generated by the data processing means, wherein the pyrolysis reaction means performs at least one of torrefaction, biochar reaction, drying, activated carbon reaction, and carbonization.

In addition, the present invention may provide various combinations of the above solving means.

Advantageous Effects of the Invention

As is apparent from the above description, it is possible to analyze the moisture content of an input raw material and the heating value of a discharged reactant in real time through the pyrolysis reaction apparatus according to the present invention, enabling efficient energy management and operation.

BRIEF DESCRIPTION OF DRAWINGS

FIG. 1 shows a pyrolysis reaction apparatus according to an embodiment of the present invention;

FIG. 2 is a photograph showing the shape of a torrefied product, which is a reactant from an input raw material depending on the reaction temperature, during torrefaction according to an embodiment of the present invention;

FIG. 3 is an experimental result of the heating value, yield, and elemental composition of an empty fruit bunch (EFB) torrefied product depending on the reaction temperature according to an embodiment of the present invention;

FIG. 4 is an experimental result of the heating value, yield, and elemental composition of an empty fruit bunch (EFB) torrefied product depending on the reaction time according to an embodiment of the present invention;

FIG. 5 is an experimental result of the heating value of an empty fruit bunch (EFB) torrefied product depending on the reaction temperature and the reaction time according to an embodiment of the present invention;

FIG. 6 shows a step of segmenting first data and second data images, converting the image color of each cell to an RGB code value, and deriving an average value according to an embodiment of the present invention;

FIG. 7 shows a step of overlapping the first data and second data images to generate an image according to an embodiment of the present invention;

FIG. 8 shows a labeling step of grouping RGB data code values and assigning labels thereto; and FIG. 9 shows a data processing step of deriving a correlation between an RGB value, water content, and a heating value and estimating the water content and the heating value corresponding to an arbitrary RFG value through simulation.

DESCRIPTION OF EMBODIMENTS

Now, preferred embodiments of the present invention will be described in detail with reference to the accompanying drawings such that the preferred embodiments of the present invention can be easily implemented by a person having ordinary skill in the art to which the present invention pertains. In describing the principle of operation of the preferred embodiments of the present invention in detail, however, a detailed description of known functions and configurations incorporated herein will be omitted when the same may obscure the subject matter of the present invention.

In addition, the same reference numbers will be used throughout the drawings to refer to parts that perform similar functions or operations. In the case in which one part is said to be connected to another part throughout the specification, not only may the one part be directly connected to the other part, but also, the one part may be indirectly connected to the other part via a further part. In addition, that a certain element is included does not mean that other elements are excluded, but means that such elements may be further included unless mentioned otherwise.

In addition, any limitations or additions to any embodiment described herein are not limited to a specific embodiment but are equally applicable to all embodiments described herein.

Also, in the description of the invention and the claims of the present application, singular forms are intended to include plural forms unless mentioned otherwise.

FIG. 1 shows a pyrolysis reaction apparatus according to an embodiment of the present invention, FIG. 2 is a photograph showing the shape of a torrefied product, which is a reactant from an input raw material depending on the reaction temperature, during torrefaction according to an embodiment of the present invention, FIG. 3 is an experimental result of the heating value, yield, and elemental composition of an empty fruit bunch (EFB) torrefied product depending on the reaction temperature according to an embodiment of the present invention, FIG. 4 is an experimental result of the heating value, yield, and elemental composition of an empty fruit bunch (EFB) torrefied product depending on the reaction time according to an embodiment of the present invention, FIG. 5 is an experimental result of the heating value of an empty fruit bunch (EFB) torrefied product depending on the reaction temperature and the reaction time according to an embodiment of the present invention, FIG. 6 shows a step of segmenting each of first data and second data images, converting the image color of each cell to an RGB code value, and deriving an average value according to an embodiment of the present invention, FIG. 7 shows a step of overlapping the first data and second data images to generate an image according to an embodiment of the present invention, FIG. 8 shows a labeling step of grouping RGB data code values and assigning labels thereto, and FIG. 9 shows a data processing step of deriving a correlation between an RGB value, water content, and a heating value and estimating the water content and the heating value corresponding to an arbitrary RFG value through simulation.

In addition, FIG. 6 shows a step of evenly segmenting each of first data and the second data images into nine or more cells, converting the image color of each cell into an RGB (red, green, blue) code value, and deriving an average value thereof.

In addition, FIG. 7 shows acquiring first data and second data images four times every 2.5 seconds, overlapping the same in a ratio of 2:8 to create one image, and generating an image to be applied to FIG. 6.

In addition, FIG. 8 shows a step of classifying code values of each of RGB data into 16 groups and assigning a total of 4,069 labels through a combination of the classified R, G, and B groups.

In addition, after image generation through FIG. 7 and labeling through FIG. 8, at least one of the heating value and the water content may be predicted through at least one of the steps of:

1) preparing labeled data to learn collected image data (this step may include data augmentation);
2) training a model to predict the heating value/water content;
3) adjusting the weight of the model and learning the relationship between the heating value, the water content, the image, and the label corresponding thereto; and
4) adjusting the hyper-parameter of the model or performing a tuning operation to improve the performance of the model through accumulated data.

The present invention provides a pyrolysis reaction method including a raw material input step of inputting a raw material and acquiring first data through a first monitoring means, a pyrolysis reaction step of pyrolyzing and moving the input raw material, a reactant discharge step of discharging a pyrolyzed reactant and acquiring second data through a second monitoring means, an image sample collection step of additionally obtaining image samples in order to improve accuracy of the first data and the second a data, DB storage step of normalizing the obtained image samples into time series data and storing RGB code values in a DB, a labeling step of assigning labels to the first data and the second data based on the stored DB values, a data processing step of assigning a water content evaluation value to the label of the first data to derive a correlation between the RGB value and the water content, assigning a heating value evaluation value to the label of the second data to derive a correlation between the RGB value and the heating value, and comparing the first data and the second data with the data stored in the DB through simulation to generate third data, which is an estimated water content, and fourth data, which is an estimated heating value, and a control value deriving step of deriving control values of the pyrolysis temperature and the pyrolysis time required to secure heating value-based quality of the pyrolyzed reactant based on the third data and the fourth data generated through the data processing step, wherein the pyrolysis reaction step is performed by a pyrolysis reaction means configured to perform at least one of torrefaction, biochar reaction, drying, activated carbon reaction, and carbonization.

Also, in the control value deriving step, the pyrolysis temperature may control at least one of the rate of rotation of a raw material supply motor of a hot air furnace, the rate of rotation of an air supply motor of the hot air furnace, and the rate of rotation of a dilution air supply motor of a gas mixer.

Also, in the control value deriving step, the pyrolysis time may control at least one of the rate of rotation of a driving motor of a rotary kiln and the rate of rotation of the raw material supply motor.

In addition, the first data and the second data may be visual information, and the visual information may be an image.

In addition, the first monitoring means may segment the image into a plurality of cells in order to acquire the first data.

In addition, the second monitoring means may segment the image into a plurality of cells in order to acquire the second data.

In addition, each of the first and second data images may be evenly segmented into nine or more cells.

In addition, the image color of each of the evenly segmented cells may be converted into an RGB code value and an average value thereof may be derived.

Also, in order to improve accuracy in the image sample collection step, image samples may be additionally obtained by applying an overlap of 80% based on 2.5 seconds.

The 2.5 seconds set in the image sample collection step may be appropriately applied depending on the circumstances, since the dwell time can be adjusted to analyze the images of the input raw material and the discharged reactant seconds through for 10 the relationship between the movement distance and the rate of rotation of a motor when a conveyor belt is used.

In addition, representative image generation and system accuracy may be improved by using an overlap method of overlapping a plurality of images.

In addition, the RGB code values may be classified into 16 groups, and 4,096 labels may be assigned through a combination of the classified R, G, and B groups.

(Example 1) Pyrolysis Temperature Control

A step of controlling an operating factor related to pyrolysis temperature to achieve a target heating value of 4,500 kcal/kg in an operating condition in which the heating value of the pyrolysis product derived from the fourth data is 4,150 kcal/kg (1) The rate of rotation of the raw material supply motor of the hot air furnace was increased by 5%.

(2) The rate of rotation of the air supply motor of the hot air furnace was increased by 7%.

(3) The rate of rotation of the dilution air supply motor of the gas mixer was decreased by 3%.

(Example 2) Pyrolysis Time Control

A step of controlling an operating factor related to pyrolysis time to achieve a target heating value of 4,500 kcal/kg in an operating condition in which the heating value of the pyrolysis product derived from the fourth data is 4,950 kcal/kg (1) The rate of rotation of the driving motor of the rotary kiln was increased by 8%.

(2) The rate of rotation of the raw material supply motor was increased by 5%.

In addition, the present invention provides a pyrolysis reaction apparatus including a raw material input means configured to input a raw material and to acquire first data through a first monitoring means, a pyrolysis reaction means configured to pyrolyze and move the input raw material, a reactant discharge means configured to discharge a pyrolyzed reactant and to acquire second data through a second monitoring means, an image sample collection means configured to additionally obtain image samples in order to improve accuracy of the first data and the second data, a DB storage means configured to normalize the obtained image samples into time series data and storing RGB code values in a DB, a labeling means configured to assign labels to the first data and the second data based on the stored DB values, a data processing means configured to assign a water content evaluation value to the label of the first data to derive a correlation between the RGB value and the water content, to assign a heating value evaluation value to the label of the second data to derive a correlation between the RGB value and the heating value, and to compare the first data and the second data with the data stored in the DB through simulation to generate third data, which is an estimated water content, and fourth data, which is an estimated heating value, and a control value deriving means configured to derive control values of the pyrolysis temperature and the pyrolysis time required to secure heating value-based quality of the pyrolyzed reactant based on the third data and the fourth data generated by the data processing means, wherein the pyrolysis reaction means performs least one of torrefaction, biochar reaction, drying, activated carbon reaction, and carbonization.

In addition, the present invention provides a rotary pyrolysis reaction apparatus 100 including a kiln type indirect pyrolysis reaction means constituted by an outer cylinder 200 configured to allow external hot air to be supplied thereinto and an inner cylinder 300 configured to allow a raw material to move therein, a pyrolysis reaction control means 900 configured to drive the pyrolysis reaction means, a raw material inlet 110 located at one side of the pyrolysis reaction means, the raw material inlet 110 being configured to allow a raw material to be input to the pyrolysis reaction means therethrough, a reactant outlet 120 located at the other side of the pyrolysis reaction means, which is opposite the raw material inlet 110, the reactant outlet 120 being configured to allow a pyrolysis reactant, which is the raw material that has been pyrolyzed, to be discharged therethrough, a hot air supply pipe 400 configured to supply hot air to the outer cylinder 200, a multipoint thermocouple 430 located at one side of the inner cylinder 300, the multipoint thermocouple 430 being configured to measure the temperature in the pyrolysis reaction means, a heat source supply quantity control means 440 connected to the multipoint thermocouple located at one side of the inner cylinder 300 and the hot air supply pipe 400, supply quantity control means 440 being configured to control hot air supplied to the outer cylinder 200, a generated gas discharge pipe 600 located at one side of the pyrolysis reaction means above the pyrolysis reaction means, the generated gas discharge pipe 600 being configured to discharge gas generated in the pyrolysis reaction means, a first monitoring means 700 installed in the vicinity of the raw material inlet 110, the first monitoring means 700 being configured to monitor a raw material input through the raw material inlet 110 and to transmit first data acquired through monitoring, a second monitoring means 710 installed in the vicinity of the reactant outlet 120, the second monitoring means 710 being configured to monitor a reactant discharged through the reactant outlet 120 and to transmit second data acquired through monitoring, and an AI analysis means 800 configured to receive the data transmitted by the first monitoring mean 700 and the second monitoring mean 710, to generate third data and fourth data based on the received first data and the received second data, to provide the third data to the heat source supply quantity control means 440, and to provide the fourth data to the pyrolysis reaction control means 900, wherein the outer cylinder 200 includes a partition plate 210 configured to divide the outer cylinder 200 into predetermined zones, and one side of the hot air supply pipe 400 and one side of the outer cylinder 200 are connected to each other via a hot air branch pipe 410 including a control valve 420.

The raw material may be a solid raw material that requires pyrolysis, such as drying, torrefaction, biochar reaction, and carbonization. For example, the raw material may include biomass (bagasse, EFB, woodchip, etc.), organic waste (animal manure, sewage sludge, food waste, etc.), and combustible waste (waste plastic, waste paper, waste rubber, etc.).

The outer cylinder 200 may be divided into two or more zones by the partition plate 210.

The multipoint thermocouple may be disposed to sense the temperature T1 to T6 in the inner cylinder 300 corresponding to the zones of the outer cylinder 200 divided by the partition plate 210.

The temperature in the inner cylinder 300, i.e. the reaction temperature, may be 100° C. to 500° C.

One or more multipoint thermocouples 430 may be located in the vicinity of the raw material inlet 110 or the reactant outlet 120 by insertion, or the multipoint thermocouple 430 may be installed in the vicinity of the raw material inlet 110 and the reactant outlet 120 by penetration.

The control valve 420 may adjust the amount of hot air that is supplied.

The outer cylinder 200 may be installed so as to surround the inner cylinder 300 while being spaced apart from the inner cylinder 300 by a predetermined distance such that a path configured to allow hot air to move therealong is defined between the outer cylinder 200 and the inner cylinder 300.

A hot air discharge pipe 500 configured to allow the hot air supplied to the outer cylinder 200 to be discharged therethrough may be further provided at one side of the outer cylinder 200.

The hot air discharge pipe 400 may be formed so as to have a double structure configured to surround the generated gas discharge pipe 600 in order to maintain the temperature of the generated gas discharge pipe 600 at a predetermined temperature or higher such that the generated gas can be used as fuel.

The hot air discharge pipe 400 may be formed so as to have a double structure such that the generated gas discharge pipe 600 is installed so as to extend in the hot air discharge pipe 400.

When the hot air discharge pipe 400 is located at a lower end of the pyrolysis reaction means, the hot air discharge pipe 400 may supply hot air to a lower part of the pyrolysis reaction means such that the most indirect contact between the hot air and the raw material occurs. In this case, heat source utilization efficiency may be slightly higher than when the hot air discharge pipe 400 is located at an upper end of the pyrolysis reaction means.

The pyrolysis reaction means may be used for at least one of torrefaction, drying, biochar reaction, activated carbon reaction, and carbonization.

At least one of the first data and the second data transmitted by the AI analysis means 800 may be based on visual information.

The first monitoring means 700 may acquire moisture content information from visual information of the input raw material.

The second monitoring means 710 may acquire heating value information from visual information of the discharged reactant.

Upon receiving the third data, the heat source supply quantity control means 440 may adjust the control valve 420 installed at the hot air branch pipe 410.

Upon receiving the fourth data, the pyrolysis reaction control means 900 may adjust the rate of rotation of the pyrolysis reaction means.

The hot air branch pipe 410 may be connected to the outer cylinder 200 so as to correspond to each of the zones of the outer cylinder 200 divided by the partition plate.

The present invention provides a pyrolysis reaction method using the pyrolysis reaction apparatus, the pyrolysis reaction method including a raw material input step of inputting a raw material and acquiring first data through the first monitoring means, a pyrolysis reaction step of pyrolyzing the input raw material and moving the pyrolyzed raw material, a reactant discharge step of discharging a reactant resulting from pyrolysis reaction and acquiring second data through the second monitoring means, a data processing step of generating third data and fourth data based on the first data and the second data, and a pyrolysis reaction apparatus control step of controlling the pyrolysis reaction apparatus based on the third data and the fourth data generated through the data processing step.

RGB refers to three primary colors of light, i.e. red, green, and blue, and an RGB color model is a way of representing colors using the three primary colors of light.

Those skilled in the art to which the present invention pertains will appreciate that various applications and modifications are possible within the category of the present invention based on the above description.

DESCRIPTION OF REFERENCE SYMBOLS

100: Rotary pyrolysis reaction apparatus
110: Raw material inlet
120: Reactant outlet
200: Outer cylinder
210: Partition plate
300: Inner cylinder
400: Hot air supply pipe
410: Hot air branch pipe
420: Control valve
430: Multipoint thermocouple
440: Heat source supply quantity control means
500: Hot air discharge pipe
600: Generated gas discharge pipe
700: First monitoring mean
710: Second monitoring means
800: AI analysis means
900: Pyrolysis reaction control means

The invention claimed is:

1. A pyrolysis reaction method comprising:

a raw material input operation of inputting a raw material and acquiring first data through a first monitor;

a pyrolysis reaction operation of pyrolyzing and moving the input raw material;

a reactant discharge operation of discharging a pyrolyzed reactant of the input raw material and acquiring second data through a second monitor;

an image sample collection operation of additionally obtaining image samples in order to improve accuracy of the first data and the second data;

a database (DB) storage operation of normalizing the obtained image samples into time series data and storing red, green and blue (RGB) code values in a DB;

a labeling operation of assigning labels to the first data and the second data based on the stored RGB code values in the DB;

a data processing operation of initially assigning a water content evaluation value to the label of the first data to derive a correlation between the RGB code values and a water content, initially assigning a heating value evaluation value to the label of the second data to derive a correlation between the RGB code values and a heating value, and comparing the first data and the second data with data stored in the DB through simulation to generate third data, which is an estimated water content, and fourth data, which is an estimated heating value; and a control value deriving operation of deriving control values of a pyrolysis temperature and a pyrolysis time required to secure heating value-based quality of the pyrolyzed reactant based on the third data and the fourth data generated through the data processing operation in order to increase the heating value and decrease the water content of the input raw material to thereby produce the pyrolyzed reactant based on a result of the data processing operation, wherein the pyrolysis reaction operation is performed by a pyrolysis reactor configured to perform at least one of torrefaction, biochar reaction, drying, activated carbon reaction, and carbonization in producing the pyrolyzed reactant from the input raw material based on the control values derived in the control value deriving operation.

2. The pyrolysis reaction method according to claim 1, wherein, in the control value deriving operation, the pyrolysis temperature controls at least one of a rate of rotation of a raw material supply motor of a hot air furnace, a rate of rotation of an air supply motor of the hot air furnace, and a rate of rotation of a dilution air supply motor of a gas mixer.

3. The pyrolysis reaction method according to claim 1, wherein, in the control value deriving operation, the pyrolysis time controls at least one of a rate of rotation of a driving motor of a rotary kiln and a rate of rotation of a raw material supply motor.

4. The pyrolysis reaction method according to claim 1, wherein the image sample collection operation comprises acquiring images at approximately 2.5-second intervals and overlapping the images to generate a composite image applied to the data processing operation.

5. The pyrolysis reaction method according to claim 1, wherein the first data and the second data are acquired by evenly segmenting a visual image into a grid of nine or more cells and deriving an average RGB code value for each cell.

6. The pyrolysis reaction method according to claim 1, wherein the labeling operation further comprises classifying the RGB code values into 16 groups to assign one of 4,096 labels to an image data of the image samples.

7. The pyrolysis reaction method according to claim 1, wherein the control value deriving operation further comprises adjusting a rate of rotation of a dilution air supply motor of a gas mixer to adjust the pyrolysis temperature.

8. The pyrolysis reaction method according to claim 1, wherein the raw material includes at least one of biomass, organic waste, and combustible waste.

9. A pyrolysis reaction apparatus comprising:

a raw material inputter configured to input a raw material and to acquire first data through a first monitor;

a pyrolysis reactor configured to pyrolyze and move the input raw material;

a reactant discharger configured to discharge a pyrolyzed reactant and to acquire second data through a second monitor;

an image sample collector configured to additionally obtain image samples in order to improve accuracy of the first data and the second data;

a database (DB) storage configured to normalize the obtained image samples into time series data and storing RGB code values in a DB;

a labeler configured to assign labels to the first data and the second data based on the stored RGB code values in the DB;

a data processor configured to perform a data processing operation to initially assign a water content evaluation value to the label of the first data to derive a correlation between the RGB code values and a water content, to initially assign a heating value evaluation value to the label of the second data to derive a correlation between the RGB code values and a heating value, and to compare the first data and the second data with data stored in the DB through simulation to generate third data, which is an estimated water content, and fourth data, which is an estimated heating value; and a control value deriver configured to derive control values of a pyrolysis temperature and a pyrolysis time required to secure heating value-based quality of the pyrolyzed reactant based on the third data and the fourth data generated by the data processor to increase the heating value and decrease the water content of the input raw material to thereby produce the pyrolyzed on a result of the data processing operation, wherein the pyrolysis reaction means reactor performs at least one of torrefaction, biochar reaction, drying, activated carbon reaction, and carbonization in producing the pyrolyzed reactant from the input raw material based on the control values derived by the control value deriver.

10. The pyrolysis reaction apparatus of claim 9, further comprising a generated gas discharge pipe and a hot air discharge pipe formed in a double structure such that the generated gas discharge pipe extends through an interior of the hot air discharge pipe.

11. The pyrolysis reaction apparatus of claim 9, wherein the pyrolysis reactor comprises an outer cylinder having a partition plate that divides the outer cylinder into at least two zones corresponding to increasing reaction temperatures.

12. The pyrolysis reaction apparatus of claim 9, wherein the raw material includes at least one of biomass, organic waste, and combustible waste.

* * * * *